US011980933B2

(12) United States Patent
Xu et al.

(10) Patent No.: US 11,980,933 B2
(45) Date of Patent: May 14, 2024

(54) CLOSED-LOOP CONTROL METHOD AND SYSTEM FOR MOLD TEMPERATURE IN WHEEL CASTING PROCESS

(71) Applicant: CITIC Dicastal Co., Ltd., Qinhuangdao (CN)

(72) Inventors: Zuo Xu, Qinhuangdao (CN); Ji Wang, Qinhuangdao (CN); Shiwei Guo, Qinhuangdao (CN); Shiwen Xu, Qinhuangdao (CN); Shide Li, Qinhuangdao (CN); Xi Li, Qinhuangdao (CN); Yiming Li, Qinhuangdao (CN); Yangfan Li, Qinhuangdao (CN); Ning Wang, Qinhuangdao (CN); Guojiang Dong, Qinhuangdao (CN); Jiang Bi, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 0 days.

(21) Appl. No.: 18/198,020

(22) Filed: May 16, 2023

(65) Prior Publication Data

US 2024/0116101 A1 Apr. 11, 2024

(30) Foreign Application Priority Data

Oct. 10, 2022 (CN) ..... 202211231569.X

(51) Int. Cl.
*B22D 18/08* (2006.01)
*B22D 18/04* (2006.01)

(52) U.S. Cl.
CPC ..... *B22D 18/08* (2013.01); *B22D 18/04* (2013.01)

(58) Field of Classification Search
CPC ..... B22D 18/04; B22D 18/08; B22D 25/00; B22D 25/02
See application file for complete search history.

(56) References Cited

FOREIGN PATENT DOCUMENTS

CN 113118417 A * 7/2021 ..... B22D 18/04

OTHER PUBLICATIONS

English machine translation of CN-113118417-A (Year: 2021).*

* cited by examiner

*Primary Examiner* — Kevin P Kerns
*Assistant Examiner* — Steven S Ha
(74) *Attorney, Agent, or Firm* — IPro, PLLC

(57) ABSTRACT

The invention relates to the field of aluminum wheel casting molds, and more particularly relates to a closed-loop control method and system for a mold temperature in a wheel casting process. The control method includes: step 1, acquiring data, that is, acquiring a plurality of mold position temperatures, and cooling pipeline opening and closing signals in a target wheel casting process according to a fixed frequency; step 2, storing, based on acquired mold opening and closing signals of casting equipment, the acquired data in a database in the form of a unique ID according to a single wheel casting process; step 3, calculating new process parameters based on the acquired plurality of position temperatures and time; and step 4, integrating the calculated process parameters, and issuing the process parameters to a PLC of a casting equipment to perform new casting. According to the invention, the temperature control parameters are calculated based on the acquired temperature data and time process to form the temperature control process of the casting process, which solves the technical problem of significant fluctuations in the quality of the low-pressure casting process of aluminum wheels and improves casting stability and yield.

7 Claims, 2 Drawing Sheets

CLOSED-LOOP CONTROL METHOD AND SYSTEM FOR MOLD TEMPERATURE IN WHEEL CASTING PROCESS

TECHNICAL FIELD

The present invention relates to the field of aluminum wheel casting molds, and particularly relates to a closed-loop control method and system for a mold temperature in wheel casting process.

BACKGROUND

In the related techniques, the casting of aluminum wheels is the most critical step in automotive part production, and the aluminum wheels are directly linked to the safety of an automobile. Whereas, since there are many factors affecting the stability of the casting process due to the variety of shapes of the aluminum wheels and multiple casting process parameters, it is necessary for timely adjustment of the process or waste disposal by visually characterizing the impact of these factors on the casting process.

In the related techniques, a strong relevant factor affecting the casting quality is mold temperature, including mold temperature values and mold temperature distribution. Changes in the pressure of a casting furnace, and opening and closing of cooling pipelines can all be visually reflected by changes in the mold temperature. However, Since the changes in the mold temperature during the casting process cannot be directly observed by people, it is only possible to perform manual evaluation on the casting process according to the internal quality of the aluminum wheels subjected to casting, and adjust the process. Moreover, manual work has strong subjectivity and is highly dependent on experience. The casting process of hub products cannot be adjusted during the casting, and thus the casting quality of the hub products varies.

SUMMARY

To this end, the present invention provides a closed-loop control method and system for a mold temperature in a wheel casting process, which overcomes the problems that the casting process of hub products cannot be adjusted, making the casting quality of the hub products vary.

To achieve the above objective, the present invention provides a closed-loop control method for a mold temperature in a wheel casting process, including:

- step 1, acquiring data, that is, acquiring a plurality of mold position temperatures, and cooling pipeline opening and closing signals in a target wheel casting process according to a fixed frequency;
- step 2, storing, based on acquired mold opening and closing signals of casting equipment, the acquired data in a database in the form of a unique ID by a host computer system according to a single wheel casting process;
- step 3, calculating new process parameters by the host computer system based on the acquired plurality of position temperatures and time; and
- step 4, integrating the calculated process parameters, and issuing the process parameters to a PLC of a casting equipment to perform new casting.

Further, the plurality of position temperatures are acquired by thermocouples. Placement positions of the thermocouples include a flange position of a top mold, a spoke middle position, a riser position of a bottom mold, a spoke-to-felloe transition position, an outer rim position of a side mold, and an inner rim position of the side mold. One thermocouple is disposed at each position.

Further, the step 3 includes:

- in a first step, splitting temperature data acquired by each of the thermocouples of each wheel according to mold closing time and mold opening time;
- in a second step, allowing each thermocouple to correspond to a to-be-controlled cooling pipeline;
- in a third step, calculating an average value of the temperatures of the thermocouple corresponding to the on and off time of cooling of the selected cooling pipeline according to a time process, wherein the average value serves as a control parameter for the on and off of cooling in a temperature process; and
- in a fourth step, calculating, according to the method of the third step, a temperature control parameter for the on and off of cooling each time, and a mold opening temperature, to finally form the temperature process.

Based on the acquired mold opening and closing signals of the casting equipment, the continuously acquired data is sliced on a single wheel basis, and the data in the production process of the same wheel is uniformly assigned to a unique ID for storage. The stored data in the casting process of each wheel includes: acquisition time, temperature values of the thermocouples at that time, a Boolean value for opening and closing of the cooling pipeline at that time, and a casting process value.

Further, the average value of the corresponding temperatures is calculated according to the on and off time of cooling in the time process, and the average value serves as the control parameter of the temperature process to control the on and off of cooling. Similarly, the corresponding temperature control parameter is also calculated for mold opening. The temperature process parameters used for controlling the casting process are finally formed.

Further, each of the thermocouples is connected to a temperature acquisition module of a PLC of the casting equipment.

The present invention also provides a closed-loop control system for a mold temperature in a wheel casting process, which is applied to the above closed-loop control method for the mold temperature in the wheel casting process, and is characterized by including:

- a communication acquisition module, communicating with a PLC of casting equipment via industrial Ethernet;
- a storage module, configured to store data acquired by the communication acquisition module; and
- a processing module, configured to process data within the storage module.

Further, the communication acquisition module acquires a plurality of mold position temperatures, cooling pipeline opening and closing signals, mold opening and closing signals of the casting equipment, and the casting process according to a fixed frequency, and records time, wherein the mold position temperatures include temperatures at a plurality of key hot spot positions or cold spot positions of the top mold, the bottom mold, and the side mold.

Further, the storage module stores the acquired data in a database in the form of a unique ID on the basis of the single wheel casting process according to the acquired mold opening and closing signals of the casting equipment in order to search all data in the single wheel casting process.

Further, the processing module calculates temperature control parameters based on the acquired temperature data and time process, to form a temperature control process for accurate control of the casting process.

The present invention also provides an electronic operation and storage device, which is applied to the above closed-loop control system for the mold temperature in the wheel casting process, and is characterized by including a processor, a communication interface, a memory and a communication bus, wherein the processor, the communication interface and the memory communicate with each other via the communication bus. The memory is configured to store a computer program and the acquired data. The processor is configured to perform the steps of data acquisition, calculation, issuance of the temperature process by running the program stored on the memory.

Compared to the prior art, the present invention has the following beneficial effects: By means of the present invention, the plurality of mold position temperatures, the cooling pipeline opening and closing signals, the mold opening and closing signals of the casting equipment, the casting process and time are acquired according to the fixed frequency, wherein the mold position temperatures include temperatures at a plurality of key hot spot positions or cold spot positions of the top mold, the bottom mold, and the side mold. The acquired data is stored in the database in the form of the unique ID according to the single wheel casting process based on the acquired mold opening and closing signals of the casting equipment in order to search all data in the single wheel casting process. The temperature control parameters are calculated based on the acquired temperature data and time process, to form the temperature control process in the casting process. Therefore, the technical problems of significant fluctuations in the quality of the low-pressure casting process of aluminum wheels are solved, precise control can be performed on the low-pressure casting process of aluminum wheels, and the casting stability and yield can be improved.

DETAILED DESCRIPTION

Figure 1:
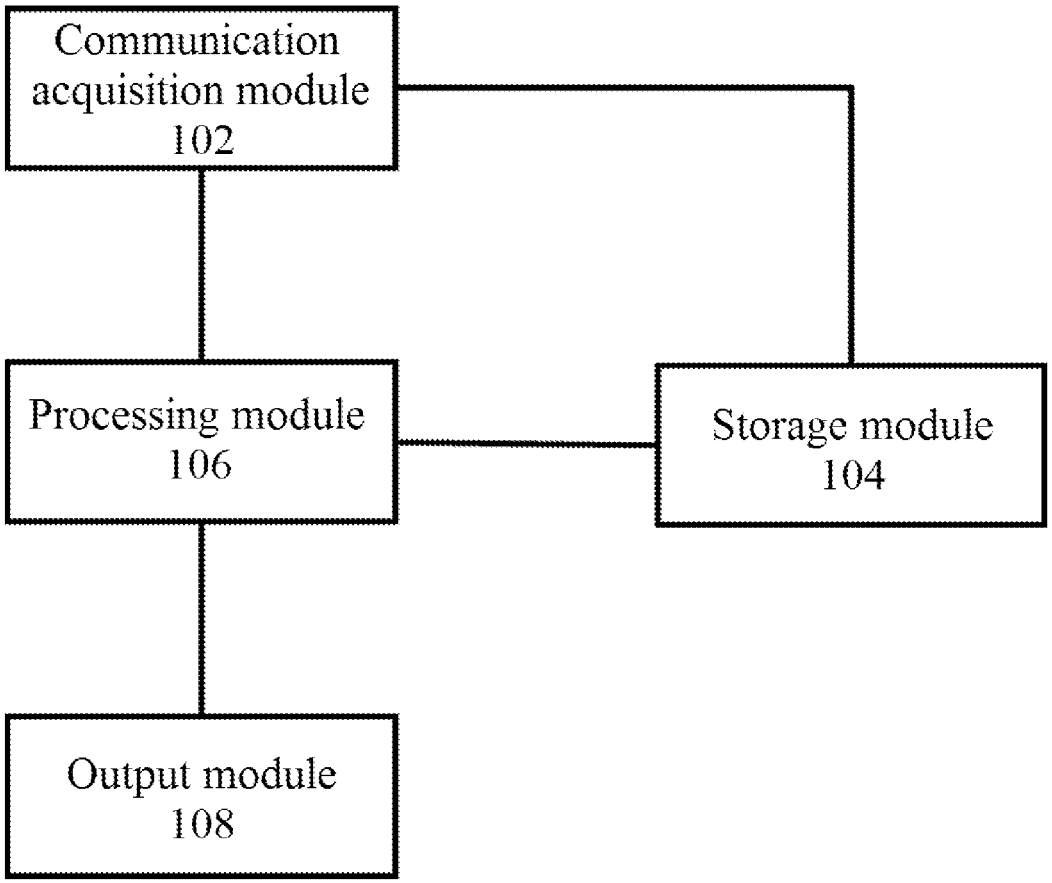
FIG. 1 is a schematic diagram of a closed-loop control system for a mold temperature in a wheel casting process according to an embodiment of the present invention.

In order that the objectives and advantages of the present invention are more clearly understood, the present invention will now be further described in conjunction with embodiments. It should be understood that the specific embodiments described herein are merely for explaining the present invention and are not intended to limit the present invention.

Preferred embodiments of the present invention are described below with reference to the accompanying drawings. It should be understood by those skilled in the art that these embodiments only serve to explain the technical principle of the present invention, rather than limiting the scope of protection of the present invention.

It should be noted that, in the description of the present invention, the terms "upper", "lower", "left", "right", "inner", "outer", and the like indicate directional or positional relationships based on the directional or positional relationships shown in the drawings, which are merely for convenience of description, are not intended to indicate or imply that the device or element must have a particular orientation, be constructed and operated in a particular orientation, and thus are not to be construed as limiting the present invention.

Furthermore, it should be noted that, unless explicitly stated and defined otherwise, the terms "mount", "connect", "link" are understood broadly throughout the description of the present invention, for example, it may be a fixed connection, also be a detachable connection, or an integral connection; it may a mechanical connection or also be an electrical connection; and it may be a direct connection or an indirect connection through an intermediate medium, and may be internal communication of two elements. Those skilled in the art may understand the specific meaning of the above terms in the present invention according to specific circumstances.

Method embodiments provided by the embodiments of the present application may be implemented in a controller, a personal computer, a server, a control device, or similar electronic devices. In an example that a personnel computer is used for running, FIG. 1 is a schematic diagram of a closed-loop control system for a mold temperature in a wheel casting process according to an embodiment of the present invention. As shown in FIG. 1, the personal computer may include one or more processing modules 106 and a storage module 104 configured to store data, and further include a communication acquisition module 102 and an output module 108. Those of ordinary skill in the art may appreciate that the structure shown in FIG. 1 is merely illustrative and does not limit the structure of the above personal computer. For example, the personal computer may also include more or fewer components than those shown in FIG. 1, or has a different configuration from that shown in FIG. 1.

The storage module 104 may be configured to store programs, for example software programs and modules for application software, for operating the personal computer, such as a temperature process calculation program for the mold temperature in the wheel casting process. The processing module 106 operates a system in the storage 104, thereby performing various functional applications and data processing, i.e., implementing the above method. The storage module 104 may include a high-speed random storage module and may also include a non-volatile storage module, such as one or more magnetic storage devices, flash memories, or other non-volatile solid-state memories. In some examples, the storage module 104 may further include a storage module remotely located with respect to the processing module 106, which may be connected to the personal computer via a network. Examples of the above network include, but are not limited to, the Internet, intranets, local area networks, mobile communication networks, and combinations thereof.

The communication acquisition module 102 is configured to receive or transmit data via a network. In one example, the communication acquisition module 102 includes a network adapter that can be connected with other network devices for communication via a base station. In one example, the communication acquisition module 102 may be an Ethernet module.

The output module 108 is configured to issue the temperature process parameter calculated by the processing module to a PLC of a casting equipment. In one example, the output module 108 includes a network adapter that can be connected with other network devices for communication via a base station. In one example, the output module 108 may be an Ethernet module.

Figure 2:
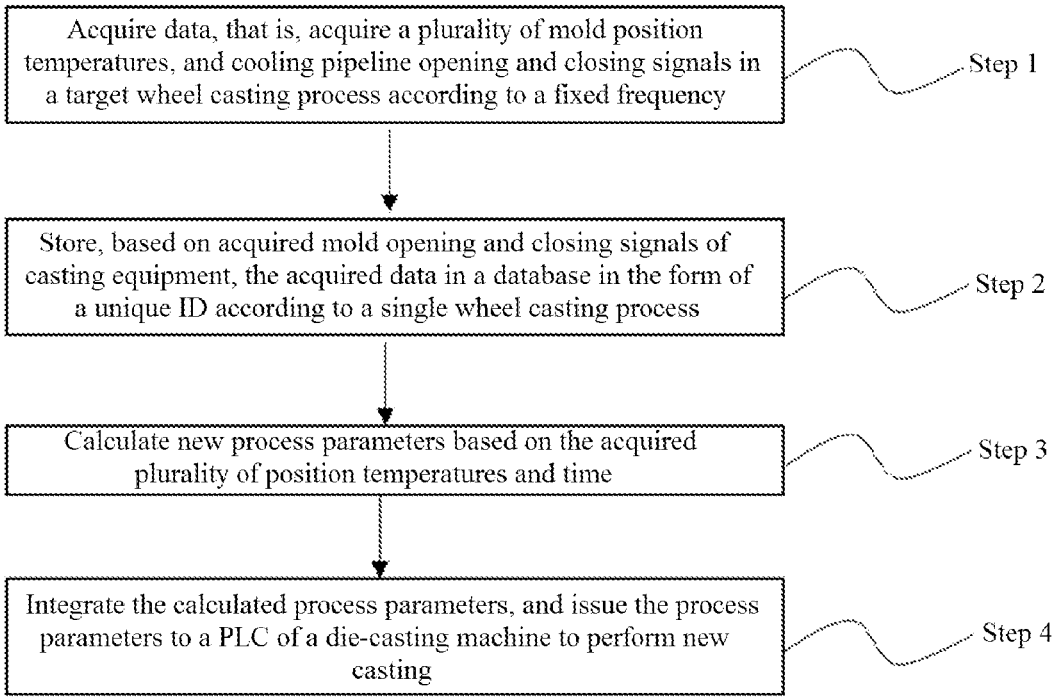
FIG. 2 is a flow chart of a mold temperature process generated in a wheel casting process.

Referring to FIG. 2, FIG. 2 is a flow chart of a mold temperature process generated in a wheel casting process.

The present invention provides a closed-loop control method for a mold temperature in a wheel casting process, including:

step 1, acquiring data, that is, acquiring a plurality of mold position temperatures, and cooling pipeline opening and closing signals in a target wheel casting process according to a fixed frequency;

step 2, storing, based on acquired mold opening and closing signals of casting equipment, the acquired data in a database in the form of a unique ID by a host computer system according to a single wheel casting process;

step 3, calculating new process parameters by the host computer system based on the acquired plurality of position temperatures and time; and step 4, integrating the calculated process parameters, and issuing the process parameters to a PLC of a casting equipment to perform new casting.

Figure 3:
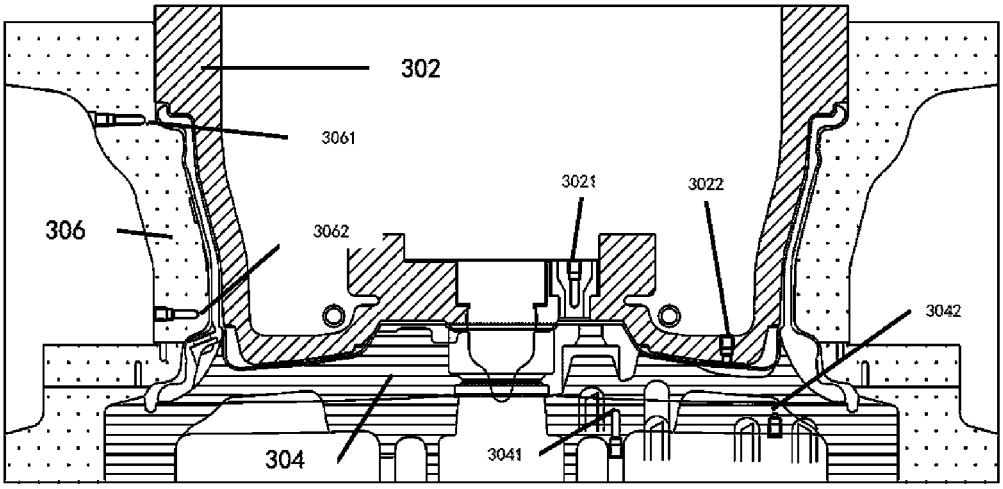
FIG. 3 is a schematic diagram showing positions of thermocouples added to an aluminum alloy wheel casting mold according to an embodiment of the present invention.

Further, the plurality of position temperatures are acquired by thermocouples. Placement positions of the thermocouples include a flange position of a top mold, a spoke middle position, a riser position of a bottom mold, a spoke-to-felloe transition position, an outer rim position of a side mold, and an inner rim position of the side mold. One thermocouple is disposed at each position. See FIG. 3 for specific placement positions. In FIG. 3, a top mold 302, a bottom mold 304, and four side molds 306 constitute a complete aluminum wheel casting mold structure. A flange position 3021 and a spoke position 3022 of the top mold 302 are hot spot positions of the mold in the casting process, so that thermocouples are additionally disposed at the flange position 3021 and the spoke position 3022 of the top mold. A riser position of the bottom mold 304 is the key position of the mold to determine the completion of casting, and determine the mold opening time, and a spoke root position is the cold spot position of the mold in the casting process, so that thermocouples are additionally disposed at the riser position 3041 and the spoke root position 3042 of the bottom mold. The inner rim positions of the side molds 306 determine the mold filling quality, and the outer rim position of the side molds 306 determine the felloe quality, so that thermocouples are additionally disposed at the inner rim positions 3061 and the outer rim positions 3062 of the side molds 306.

Further, the step 3 includes:

in a first step, splitting temperature data acquired by each of the thermocouples of each wheel according to mold closing time and mold opening time;

in a second step, allowing each thermocouple to correspond to a to-be-controlled cooling pipeline, and setting the thermocouple at the riser position 3041 to be the thermocouple for controlling mold opening;

in a third step, calculating an average value of the temperatures of the thermocouples corresponding to the on and off time of cooling of the selected cooling pipeline according to a time process, wherein the average value serves as a control parameter for the on and off of cooling in a temperature process; calculating the average value of the corresponding temperatures of the thermocouples according to the mold opening signal, wherein the average value serves as mold opening temperature; and in a fourth step, calculating, according to the method of the third step, a temperature control parameter for the on and off of cooling each time, and a mold opening temperature, to finally form the temperature process.

Based on the acquired mold opening and closing signals of the casting equipment, the continuously acquired data is sliced on a single wheel basis, and the data in the production process of the same wheel is uniformly assigned to a unique ID for storage. The stored data in the casting process of each wheel includes: acquisition time, temperature values of the thermocouples at that time, a Boolean value for opening and closing of the cooling pipeline at that time, and a casting process value.

Further, the average value of the corresponding temperatures is calculated according to the on and off time of cooling in the time process, and the average value serves as the control parameter of the temperature process to control the on and off of cooling. Similarly, the corresponding temperature control parameter is also calculated for mold opening. The temperature process parameters used for controlling the casting process are finally formed.

Further, each of the thermocouples is connected to a temperature acquisition module of a PLC of the casting equipment.

At the time of data acquisition, the plurality of mold position temperatures, and the mold opening and closing signals of the casting equipment in the target wheel casting process are acquired according to the fixed frequency of 1 Hz.

The acquired temperature data is stored in a database in the form of a unique ID on the basis of the single wheel casting process according to the acquired mold opening and closing signals of the casting equipment in order to facilitate search. In one implementation mode of this embodiment, the temperature data acquired in the target wheel casting process is searched using "acquire serial number of casting equipment_mold closing signal time" as the unique ID for the single wheel.

The thermocouple is selected for cooling to be controlled based on the cooling pipeline and the position of the thermocouples, and the thermocouple closest to the cooling is selected as the thermocouple to control the on and off of the cooling according to the principle of proximity. However, the thermocouples for the top mold, the bottom mold and the side molds cannot be used interchangeably, for example, the thermocouples for the bottom mold cannot be used to control the cooling of the other mold.

In this embodiment, a calculation method for the mold temperature in the wheel casting process is provided, wherein cooling of a bottom mold B1 is taken as an example.

According to the principle of proximity, the thermocouple at the riser position of the bottom mold is selected as the basis for controlling cooling of the B1. First, the temperature curves of 10 wheels during stable production according to the time process are selected, temperature values X1, X2 . . . X10 at the time of 50 s of cooling on the respective curves are taken, and an average value of the temperatures at this position is calculated:

$$\bar{X} = \frac{x_1 + x_2 + \ldots + x_{10}}{10}.$$

Similarly, an average value $\bar{y}$ of the temperatures when cooling is off is calculated to obtain an on temperature $\bar{X}$ and an off temperature $\bar{y}$ under the temperature process for cooling of the B1.

In this embodiment, the temperature control parameters for the other cooling and mold opening are calculated according to the same method.

Those of ordinary skill in the art may understand that the above calculation method for the temperature control parameters is merely illustrative and does not limit the above calculation method for the temperature control parameters, and other calculation methods such as medians also fall within the scope of protection of the present method.

The host computer system integrates the temperature variations of the respective thermocouples at the corresponding positions, and generates standard temperature curves for the corresponding positions of the respective thermocouples, wherein the standard temperature curve for the flange position of the top mold is L1, the standard temperature curve for the spoke position of the top mold is L2, the standard temperature curve for the riser position of the bottom mold is L3, the standard temperature curve for the spoke root position of the bottom mold is L4, the standard temperature curve for the inner rim positions of the side molds is L5, and the standard temperature curve for the outer rim positions of the side molds is L6.

Upon completion of calculation for the temperature process in the casting process, the process parameters are issued to the PLC by the host computer system, the mold temperature is monitored in real time during the casting process, and cooling is controlled to be on and off based on the temperature process parameters. Therefore, closed-loop control of the mold temperature in the casting process is achieved.

During the implementation of the process, the PID control technique is applied to adjust the on and off temperatures and flow rate of the cooling pipeline of the mold in real time to achieve that the mold temperature in the casting process remains within a stable value range all the time.

Taking the opening and closing of the cooling pipeline in the riser position of the bottom mold as an example, the temperatures acquired by the thermocouple at this position are integrated and analyzed in real time by the PLC of the casting equipment, and the PLC of the casting equipment is internally provided with a preset opening time point t1 and a preset closing time point t2 of the cooling pipeline at the riser position of the bottom mold.

For any one time of casting, the PLC of the casting equipment integrates the temperatures acquired by the thermocouple at the riser position of the bottom mold, and generates a real-time temperature variation curve P3 of the riser position of the bottom mold. When the recording duration of the real-time temperature variation curve P3 reaches the preset opening time point t1 of the cooling pipeline, the PLC of the casting equipment compares a temperature value Wa corresponding to the time point t1 on the real-time temperature variation curve P3 with a temperature value Za corresponding to time point t1 on the standard temperature curve L3, and calculates an absolute value Ya of a difference between Wa and Za, wherein $Ya=|Wa-Za|$, and an evaluation value Qa for the cooling-on temperature difference is preset within the PLC of the equipment PLC.

When $Ya \leq Qa$, the PLC of the casting equipment determines that no adjustment is necessary for the opening status of the cooling pipeline at the riser position of the bottom mold, and the PLC of the casting equipment controls the cooling pipeline at the riser position of the bottom mold to be opened according to the preset process.

When $Ya > Qa$, the PLC of the casting equipment determines that the opening status of the cooling pipeline at the riser position of the bottom mold needs to be adjusted.

When $Wa > Za$, the PLC of the casting equipment determines that the real-time temperature of the casting process is too high, and the PLC of the casting equipment controls the opening of the cooling pipeline at the riser position of the bottom mold and adjusts the flow rate of cooling liquid, wherein the preset flow rate of the cooling liquid in the cooling pipeline at the riser position of the bottom mold is Va. The PLC of the casting equipment adjusts the preset flow rate according to the value Ya, and the adjusted flow rate is Va', wherein $Va'=Va\times(1+Ya\times y)$, where y is the calculated compensation parameter of the absolute value of the temperature difference to the adjustment of the flow rate.

When the cooling pipeline is opened with Va' as the flow rate of the cooling liquid, the thermocouple at the riser position of the bottom mold detects the temperature at the corresponding position in real time and transmits the detection result to the PLC of the casting equipment. The PLC of the casting equipment continues to integrate the acquired temperatures and supplements and extends the real-time temperature variation curve P3. Meanwhile, the PLC of the casting equipment compares the temperatures at the corresponding moments on the real-time temperature variation curve P3 and the standard temperature curve L3 in real time, wherein the comparative temperature on the real-time temperature variation curve P3 is Wb, and the temperature at the corresponding moment on the standard temperature curve L3 is Zb. When $Wb \leq Zb+Qa\div 2$, the PLC of the casting equipment adjusts the flow rate of the cooling liquid to be the preset flow rate Va of the cooling liquid in the cooling pipeline.

When the cooling pipeline is opened with Va' as the flow rate of the cooling liquid, the PLC of the casting equipment records duration Tk that the cooling pipeline is opened with Va' as the flow rate of the cooling liquid, and an evaluation value Tp of the duration for the increased flow rate of the cooling liquid is set in the PLC of the casting equipment. The PLC of the casting equipment compares Tk with the evaluation value Tp of the duration for the increased flow rate of the cooling liquid, and when $Tk \geq Tp$, the PLC of the casting equipment determines that the temperature at the riser position of the bottom mold is abnormal and records the serial number of the cast wheel, and the quality inspection focuses on this wheel after the casting is completed. When $Tk < Tp$, and the PLC of the casting equipment has adjusted the flow rate of the cooling liquid to be the preset flow rate Va of the cooling liquid in the cooling pipeline, the PLC of the casting equipment does not lay emphasis on the recording of the serial number of the cast wheel.

When $Wa < Za$, the PLC of the casting equipment determines that the real-time temperature in the casting process is too low, and controls the opening time of the cooling pipeline at the riser position of the bottom mold to be delayed, and the thermocouple at the riser position of the bottom mold detects the temperature at the corresponding position in real time, and transmits the detection result to the PLC of the casting equipment. The PLC of the casting equipment continues to integrate the acquired temperatures and supplements and extends the real-time temperature variation curve P3. Meanwhile, the PLC of the casting equipment compares the temperatures at the corresponding moments on the real-time temperature variation curve P3 and the standard temperature curve L3 in real time, wherein the comparative temperature on the real-time temperature variation curve P3 is We, and the temperature at the corresponding moment on the standard temperature curve L3 is Zc. When Wc>Zc−Qa÷2, the PLC of the casting equipment controls the cooling pipeline to be opened, and the flow rate of the cooling liquid is Va.

When the PLC of the casting equipment controls the opening time of the cooling pipeline at the riser position of the bottom mold to be delayed, the PLC of the casting equipment records the duration Ty for delayed opening, and is set with an evaluation value Tq of the duration for delayed opening. When Ty≥Tq, the PLC of the casting equipment records the serial number of the cast wheel, and the quality inspection focuses on this wheel after the casting is completed. When Ty<Tq, the PLC of the casting equipment does not lay emphasis on the recording of the serial number of the cast wheel.

When a situation in which the PLC of the casting equipment records the serial number of the cast wheel occurs in succession, the PLC of the casting equipment determines that an error occurs in the casting process or the casting equipment fails, and generates an alarm to the host computer system.

When the cooling liquid cools the riser position of the bottom mold at the flow rate Va, the thermocouple at the riser position of the bottom mold detects the temperature at the corresponding position in real time, and transmits the detection result to the PLC of the casting equipment. The PLC of the casting equipment continues to integrate the acquired temperatures and supplements and extends the real-time temperature variation curve P3. Meanwhile, the PLC of the casting equipment compares the temperatures at the corresponding moments on the real-time temperature variation curve P3 and the standard temperature curve L3 in real time, wherein the comparative temperature on the real-time temperature variation curve P3 is Wd, and the temperature at the corresponding moment on the standard temperature curve L3 is Zd. The PLC of the casting equipment calculates an absolute value Yd of a difference between Wd and Zd, wherein Yd=|Wd−Zd|, an evaluation value Qd of the temperature difference in the cooling process is preset within the PLC of the equipment. The PLC of the casting equipment compares Yd with Qd, when Yd≤Qd, the PLC of the casting equipment makes no adjustment to the flow rate of the cooling liquid; and when Yd>Qd, the PLC of the casting equipment adjusts the flow rate of the cooling liquid, wherein the adjusted flow rate is Va".

When Wd>Zd, Va"=Va×(1+Yd×d1), wherein d1 is an adjustment parameter for increasing the flow rate of the cooling liquid in the casting process.

When Wd<Zd, Va"=Va×(1−Yd×d2), wherein d2 is an adjustment parameter for decreasing the flow rate of the cooling liquid in the casting process.

When the cooling pipeline uses Va" as the flow rate of the cooling liquid, the thermocouple at the riser position of the bottom mold detects the temperature at the corresponding position in real time, and transmits the detection result to the PLC of the casting equipment. The PLC of the casting equipment continues to integrate the acquired temperatures and supplements and extends the real-time temperature variation curve P3. Meanwhile, the PLC of the casting equipment compares the temperatures at the corresponding moments on the real-time temperature variation curve P3 and the standard temperature curve L3 in real time, wherein the comparative temperature on the real-time temperature variation curve P3 is We, and the temperature at the corresponding moment on the standard temperature curve L3 is Ze.

When |We−Ze|<Qd÷2, the PLC of the casting equipment adjusts the flow rate of the cooling liquid to be the preset flow rate Va of the cooling liquid in the cooling pipeline.

The present invention also provides an electronic operation and storage device, which is applied to the above closed-loop control system for the mold temperature in the wheel casting process, and is characterized by including a processor, a communication interface, a memory and a communication bus, wherein the processor, the communication interface and the memory communicate with each other via the communication bus. The memory is configured to store a computer program and the acquired data. The processor is configured to perform the steps of data acquisition, calculation, issuance of the temperature process by running the program stored on the memory.

In this embodiment, the above electronic operation and storage device may be configured to store a system for performing the following steps:

S1, acquiring a plurality of mold position temperatures, cooling pipeline opening and closing signals for a target wheel casting process according to a fixed frequency;

S2, storing, based on acquired mold opening and closing signals of casting equipment, the acquired data in a database in the form of a unique ID according to a single wheel casting process to facilitate searching;

S3, selecting a thermocouple corresponding to a temperature process based on the cooling pipeline;

S4, calculating the temperature process based on the acquired mold temperature and time process; and S5, issuing the temperature process to the PLC of the casting machine to perform casting.

Optionally, in this embodiment, the above electronic operation and storage device may include, but is not limited to, a USB disk, a read only memory, a random access memory, a removable hard disk, a magnetic disk, an optical disk, or other a variety of media capable of storing the computer program.

An embodiment of the present invention also provides an electronic device, including a communication acquisition module, a storage module and a processing module, wherein the storage module stores a computer program, and the processing module is configured to run the computer program to perform the steps of any one of the above method embodiments.

Optionally, the above electronic device may further include an input/output module, wherein the communication acquisition module is connected with the above processing module, and the input/output module is connected to the above processing module.

Optionally, specific examples in this embodiment may refer to the examples described in the above embodiments and optional implementations, which are not repeated here.

In the several embodiments provided herein, it should be understood that the disclosed technical content may be implemented in other ways. The system embodiments described above are merely illustrative. For example, the division of modules is just achieved based on logical functions, and can also be achieved in other ways in actual implementation. For example, multiple modules may be combined or integrated into another system, or some features may be ignored or not performed. In another aspect, the mutual coupling or direct coupling or communication connection shown or discussed may be indirect coupling or communication connection via some interfaces, units, or modules, and may be in an electrical form or other forms.

The integrated module, if implemented in the form of a software functional unit and sold or used as a stand-alone product, may be stored in a computer-readable storage medium or electronic device. Based on such understanding, a part of the technical solutions of this application, essentially or contributing to the related art, or all or a part of the technical solutions, may be embodied in the form of a software product, and the computer software product is stored in a storage medium and includes a plurality of instructions configured to make an electronic device (which may be a personal computer, a server, a network device, or the like) perform all or part of the steps of the methods in the various embodiments of the present application. The storage media mentioned above includes a USB disk, a read only memory, a random access memory, a removable hard disk, a magnetic disk, or other a variety of media capable of storing program codes.

So far, the technical solutions of the present invention have been described in conjunction with the preferred embodiments illustrated in the accompanying drawings, but it should be understood by those skilled in the art that the scope of protection of the present invention is obviously not limited to these specific embodiments. Those skilled in the art, without departing from the principle of the present invention, may make equivalent changes or substitutions to the relevant technical features, and these technical solutions subjected to equivalent changes or substitutions will fall within the scope of protection of the present invention.

The invention claimed is:

1. A closed-loop control method for a mold temperature in a wheel casting process, comprising:

step 1, acquiring data including a plurality of mold position temperatures, and cooling pipeline opening and closing signals in the wheel casting process according to a fixed frequency;

step 2, storing, based on acquired mold opening and closing signals of casting equipment, the acquired data in a database in the form of a unique ID according to a single wheel casting process;

step 3, calculating new process parameters by a host computer system based on the acquired plurality of position temperatures and time; and step 4, integrating the calculated new process parameters, and issuing the process parameters to a PLC of a casting equipment to perform new casting.

2. The closed-loop control method for the mold temperature in the wheel casting process according to claim 1, characterized in that the plurality of mold position temperatures are acquired by thermocouples, placement positions of the thermocouples include a flange position of a top mold, a spoke middle position, a riser position of a bottom mold, a spoke-to-felloe transition position, an outer rim position of a side mold, and an inner rim position of the side mold; and one thermocouple is disposed at each position.

3. The closed-loop control method for the mold temperature in the wheel casting process according to claim 2, characterized in that the step 3 comprises:

in a first step, splitting temperature data acquired by each of the thermocouples of a wheel according to a mold closing time and a mold opening time;

in a second step, allowing each thermocouple to correspond to a to-be-controlled cooling pipeline;

in a third step, calculating an average value of the temperatures of the thermocouple corresponding to an on and an off time of cooling of a selected cooling pipeline according to a time process, wherein the average value serves as a control parameter for the on and off of cooling in a temperature process; and in a fourth step, calculating, according to the method of the third step, a temperature control parameter for the on and off of cooling, and a mold opening temperature, to finally form the temperature process.

4. The closed-loop control method for the mold temperature in the wheel casting process according to claim 3, characterized in that each of the thermocouples is connected to a temperature acquisition module of a PLC of the casting equipment.

5. A closed-loop control system for a mold temperature in a wheel casting process, configured to employ the closed-loop control method for the mold temperature in the wheel casting process of claim 1, and comprising:

a communication acquisition module, communicating with a PLC of casting equipment via industrial Ethernet;

a storage module, configured to store data acquired by the communication acquisition module; and a processing module, configured to process data within the storage module; wherein the communication acquisition module configured to acquire a plurality of mold position temperatures, cooling pipeline opening and closing signals, mold opening and closing signals of the casting equipment, and a casting process according to a fixed frequency, and records time, wherein the plurality of mold position temperatures comprise temperatures at a plurality of key hot spot positions or cold spot positions of a top mold, a bottom mold, and a side mold.

6. The closed-loop control system for the mold temperature in the wheel casting process according to claim 5, characterized in that the storage module is configured to store the acquired data in a database in the form of a unique ID on the basis of the wheel casting process according to the acquired mold opening and closing signals of the casting equipment in order to search all data in the single wheel casting process.

7. The closed-loop control system for the mold temperature in the wheel casting process according to claim 6, wherein the processing module calculates temperature control parameters based on the acquired temperature and time data, to form a temperature control process for control of the casting process.

* * * * *